US009983518B2

(12) United States Patent
Kubo et al.

(10) Patent No.: US 9,983,518 B2
(45) Date of Patent: May 29, 2018

(54) INTERMEDIATE TRANSFER BELT, IMAGE FORMING APPARATUS AND IMAGE FORMING METHOD

(71) Applicants: Hidetaka Kubo, Shizuoka (JP); Jun Aoto, Shizuoka (JP)

(72) Inventors: Hidetaka Kubo, Shizuoka (JP); Jun Aoto, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/459,480

(22) Filed: Mar. 15, 2017

(65) Prior Publication Data

US 2017/0269513 A1 Sep. 21, 2017

(30) Foreign Application Priority Data

Mar. 17, 2016 (JP) ..... 2016-054424
Jul. 8, 2016 (JP) ..... 2016-136050

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

| | | | | |
|---|---|---|---|---|
| 7,361,400 | B2 * | 4/2008 | Shimamura | G03G 15/0818 399/111 |
| 8,521,073 | B2 | 8/2013 | Kubo et al. | |
| 8,760,717 | B2 | 6/2014 | Kubo et al. | |
| 2013/0004212 | A1 * | 1/2013 | Kubo | G03G 15/162 399/302 |

FOREIGN PATENT DOCUMENTS

| | | | |
|---|---|---|---|
| JP | 2002-162767 | A | 6/2002 |
| JP | 2004-354716 | A | 12/2004 |
| JP | 2007-328165 | A | 12/2007 |
| JP | 2009-75154 | A | 4/2009 |
| JP | 2012-189724 | A | 10/2012 |
| JP | 2015-148660 | A | 8/2015 |

* cited by examiner

*Primary Examiner* — Gregory H Curran
(74) *Attorney, Agent, or Firm* — Oblon, McClelland, Maier & Neustadt, L.L.P.

(57) ABSTRACT

An intermediate transfer belt, configured to receive a toner image formed by developing a latent image formed on an image bearing member with a toner, includes a base layer and an elastic layer. The elastic layer has an irregular surface formed with spherical particles, and the spherical particles include flexible particles having 0.1 MPa to 30 MPa of compressive strength and 15% to 50% of restoring ratio at the time of 10% deformation. Image forming apparatus. Image forming method.

19 Claims, 5 Drawing Sheets

INTERMEDIATE TRANSFER BELT, IMAGE FORMING APPARATUS AND IMAGE FORMING METHOD

CROSS-REFERENCE TO RELATED APPLICATIONS

This patent application is based on and claims priority pursuant to 35 U.S.C. § 119 to Japanese Patent Application No. 2016-054424, filed on Mar. 17, 2016 and Japanese Patent Application No. 2016-136050, filed on Jul. 8, 2016 in the Japan Patent Office, the entire disclosures of which are hereby incorporated by reference herein.

BACKGROUND

Technical Field

The present application relates to an intermediate transfer belt, image forming apparatus and image forming method.

Description of the Related Art

Conventionally, a seamless belt has been used as a member of an electrophotographic device for various uses. Especially, recent full-color electrophotographic devices employ an intermediate transfer belt system, in which developed images of four colors, yellow, magenta, cyan, and black, are superimposed on an intermediate transfer member temporarily, followed by being collectively transferred onto a transfer medium, such as paper.

As for the aforementioned intermediate transfer belt, a system using developing units of four respective colors to one photoconductor has been used, but this system has a problem in that a printing speed thereof is slow. Accordingly, to achieve high speed printing, a quadruple-tandem system has been used, where the tandem system includes providing photoconductors of four respective colors, and an image of each color is continuously transferred to paper. In this system, however, it is very difficult to accurately position images of colors to be superimposed, because the position of paper changes as affected by the environment, which causes displacement of the colors in the image. Accordingly, currently, an intermediate transfer belt system has been mainly adapted for the quadruple-tandem system.

Under the circumstances as mentioned above, the higher requirements for performance properties (e.g., high speed transferring, and accuracy for positioning) of an intermediate transfer belt have been demanded than before, and therefore it is necessary for an intermediate transfer belt to satisfy these requirements. Especially for the accuracy for positioning, it has been required to inhibit variations caused by deformation of an intermediate transfer belt itself, such as stretching, after continuous use thereof. Moreover, an intermediate transfer belt is desired to have flame resistance as it is provided over a wide region of a device, and high voltage is applied thereto for transferring. To satisfy these demands, a polyimide resin, polyamide imide resin, or the like, that is a highly elastic and highly heat resistant resin, has been mainly used as a material of an intermediate transfer belt.

Recently, full-color electrophotographic images have been more frequently formed on various types of paper such as slippery coated paper having high smoothness, recycle paper, emboss paper, Japanese paper, and craft paper having rough surfaces. The followability on papers having different surfaceness has importance, and poor followability causes uneven image density or color tone.

In order to solve this problem, various intermediate transfer belts each formed of a substrate and an elastic layer comparatively having flexibility layered thereon are disclosed. And a method of forming a protection layer is disclosed. However, when a material having fully high transferability is coated on the flexible layer, it is unable to follow flexibility thereof, resulting in cracking or peeling. Besides, in order to develop transfer ability intermediate transfer belts with adhered particles on the surface are disclosed.

SUMMARY

An intermediate transfer belt, configured to receive a toner image formed by developing a latent image formed on an image bearing member with a toner, that includes a base layer and an elastic layer. The elastic layer is over the base layer and has an irregular surface formed with spherical particles. The spherical particles include flexible particles having 0.1 MPa to 30 MPa of compressive strength, and a 15% to 50% restoring ratio at 10% deformation.

BRIEF DESCRIPTION OF THE DRAWINGS

Various other objects, features and attendant advantages of the present application will be more fully appreciated as the same becomes better understood from the detailed description when considered in connection with the accompanying drawings in which like reference characters designate like corresponding parts throughout and wherein.

DETAILED DESCRIPTION

Figure 1:
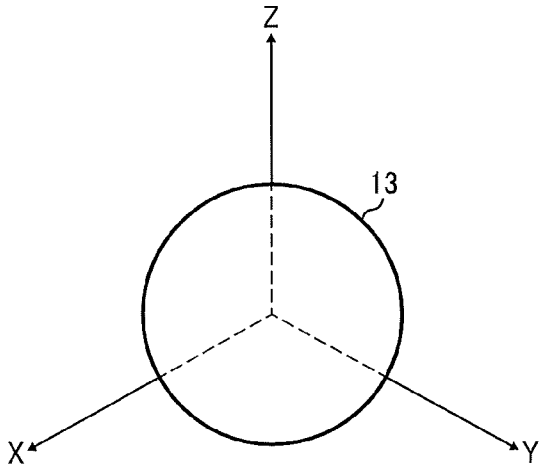
FIG. 1 is a schematic view illustrating a shape of a spherical particle of the present application.

An object of the present application is to provide an intermediate transfer belt capable of high transferability, inhibiting detachment of particles at low-temperature and low-humidity and high durability.

(Intermediate Transfer Belt)

An intermediate transfer belt, configured to receive a toner image formed by developing a latent image formed on an image bearing member with a toner, includes a base layer and an elastic layer. The elastic layer is arranged over the base layer (including in contact therewith) and has an irregular surface containing spherical particles. The spherical particles include flexible particles having 0.1 MPa to 30 MPa of compressive strength and 15% to 50% of restoring ratio at the time of 10% deformation. The intermediate transfer belt preferably also includes spherical particles including hard particles having beyond 30 MPa of compressive strength and less than 15% of restoring ratio at the time of 10% deformation. And the intermediate transfer belt can have other component as necessary.

The intermediate transfer belt of the present application addresses problems encountered using conventional hard organic particles, for example silicone resin and fluorine resin, such as detachment of particles by sliding between edge of paper and the particles at low-temperature and low-humidity (for example 10° C. and 15% RH), which begets abnormal images.

<Base Layer>

The base layer contains at least a resin, and an electrical resistance controlling agent, and may further contain other components.

—Resin—

The resin is appropriately selected depending on the intended purpose without any limitation, which is within the skill of the ordinary artisan, but for example, a fluororesin (e.g., PVDF, and ETFE), a polyimide resin, and a polyamide imide resin are preferable in view of flame resistance and a polyimide resin and a polyamide imide resin are particularly preferable in view of their mechanical strength (high elasticity) and thermal resistance. Mixtures can be used.

As for the polyimide and polyamide imide, common products readily available from manufacturers, such as Du Pont-Toray Co., Ltd., Ube Industries, Ltd., New Japan Chemical Co., Ltd., JSR Corporation, UNITIKA LTD., I.S.T., Hitachi Chemical Co., Ltd., TOYOBO CO., LTD., and Arakawa Chemical Industries, Ltd., can be used.

—Electrical Resistance Controlling Agent—

The electrical resistance controlling agent is a type of filler (or additive) for adjusting electrical resistance of the resin. The electrical resistance controlling agent is appropriately selected depending on the intended purpose without any limitation, which is within the skill of the ordinary artisan, and examples thereof include metal oxide, carbon black, an ion conductive agent, and an electric conductive polymer material. These may be used alone, or in combination.

Examples of the metal oxide include zinc oxide, tin oxide, titanium oxide, zirconium oxide, aluminum oxide, and silicon oxide. Other examples thereof include products obtained by subjecting the above meal oxide to a surface treatment for improving dispersibility thereof.

Examples of the carbon black include ketjen black, furnace black, acetylene black, thermal black and gas black.

Examples of the ion conductive agent include a tetraalkyl ammonium salt, a trialkylbenzyl ammonium salt, an alkylsulfonic acid salt, an alkylbenzenesulfonic acid salt, alkylsulfate, glycerin fatty acid ester, sorbitan fatty acid ester, polyoxyethylenealkylamine, ester of polyoxyethylenealiphatic alcohol, alkyl betaine, and lithium perchlorate.

Examples of the electric conductive polymer material include polyparaphenylene, polyaniline, polythiophene and polyparaphenylene vinylene.

An amount of the electrical resistance controlling agent is appropriately selected depending on the intended purpose without any limitation, which is within the skill of the ordinary artisan. In the case where the electrical resistance controlling agent is carbon black, the amount thereof is preferably 10% by mass to 25% by mass, more preferably 15% by mass to 20% by mass, relative to the total solid content of the coating liquid. In the case where the electrical resistance controlling agent is metal oxide, the amount thereof is preferably 1% by mass to 50% by mass, more preferably 10% by mass to 30% by mass, relative to the total solid content of the coating liquid. When the amounts of the electrical resistance controlling agents are smaller than the aforementioned lower limits respectively, it can be difficult to control the electrical resistance. When the amounts of the electrical resistance controlling agents are greater than the aforementioned upper limits respectively, the mechanical strength of the intermediate transfer belt can be reduced, which is not preferable on practical use.

—Other Components—

Moreover, a coating liquid containing at least a resin component, which is used for production of the aforementioned seamless belt, may further contain additives, such as a dispersion aid, a reinforcing agent, a lubricant, a heat conducting material, and an antioxidant, all of which end up in the base layer.

A thickness of the base layer is appropriately selected depending on the intended purpose without any limitation, which is within the skill of the ordinary artisan, but it is preferably 30 μm to 150 μm, more preferably 40 μm to 120 μm, and even more preferably 50 μm to 80 μm. When the thickness of the base layer is within the aforementioned even more preferable range, it is advantageous in terms of durability. It is preferred that the base layer have hardly any unevenness in its thickness to enhance its running stability.

A method for measuring the thickness of the base layer is appropriately selected depending on the intended purpose without any limitation, and examples thereof include a method for measuring the thickness thereof by means of a contact-type or eddy current type thickness tester, and a method for measuring a cross-section of the film with a scanning electron microscope (SEM).

<Elastic Layer>

The elastic layer is appropriately selected depending on the intended purpose without any limitation, which is within the skill of the ordinary artisan, but the elastic layer at least has an irregular surface formed with spherical particles and includes elastic components. And the elastic layer can include other components if necessary.

The shape of the irregular surface on the elastic layer can be observed by LEXTOLS4100 (manufactured by OLYMPUS CORPORATION) etc.

—Material for Forming Elastic Layer—

A material for forming the elastic layer is appropriately selected depending on the intended purpose without any limitation, which is within the skill of the ordinary artisan, and commonly used materials, such as a resin, elastomer, and rubber, can be used. However, it is preferred that a material having sufficient flexibility (elasticity) to sufficiently exhibit the effect of the present application be used. An elastomer material or a rubber material is preferable. Mixtures can be used.

Examples of the elastomer material include: thermoplastic elastomers, such as a polyester elastomer, a polyamide elastomer, a polyether elastomer, a polyurethane elastomer, a polyolefin elastomer, a polystyrene elastomer, a polyacryl elastomer, a polydiene elastomer, a silicone-modified polycarbonate elastomer, and a fluorocopolymer elastomer; and thermosetting elastomers, such as a polyurethane elastomer, a silicone-modified epoxy elastomer, and a silicone-modified acryl elastomer.

Examples of the rubber material include isoprene rubber, styrene rubber, butadiene rubber, nitrile rubber, ethylenepropylene rubber, butyl rubber, silicone rubber, chloroprene rubber, acrylic rubber, chlorosulfonated polyethylene, fluorine rubber, urethane rubber, and hydrin rubber.

As for the material for forming the elastic layer, a material that will give desirable properties can be appropriately selected from various elastomers and rubbers, such as those described above, but an acrylic rubber is particularly preferable for the present application in view of ozone resistance, flexibility, adhesion to spherical particles, flame resistance, and stability to environment. The acrylic rubber will be explained hereinafter.

The acrylic rubber may be any of products currently commercially available, and is appropriately selected depending on the intended purpose without any limitation, which is within the skill of the ordinary artisan. Among various crosslinked (e.g. epoxy group, active chlorine group, and carboxyl group) acrylic rubbers, however, a carboxyl group-crosslinked acrylic rubber is preferable because the carboxyl group-crosslinked acrylic rubber is excellent in rubber properties (especially permanent compression set) and workability.

The crosslinking agent used for the carboxyl group-crosslinked acrylic rubber is appropriately selected depending on the intended purpose without any limitation, which is within the skill of the ordinary artisan, but it is preferably an amine compound, more preferably a polyvalent amine compound.

Examples of the amine compound include an aliphatic polyamine crosslinking agent, and an aromatic polyamine crosslinking agent. Mixtures can be used.

Examples of the aliphatic polyamine crosslinking agent include hexamethylene diamine, hexamethylene diamine carbamate, and N,N'-dicinnamylidene-1,6-hexane diamine.

Examples of the aromatic polyamine crosslinking agent include 4,4'-methylene dianiline, m-phenylene diamine, 4,4'-diaminodiphenyl ether, 3,4'-diaminodiphenyl ether, 4,4'-(m-phenylene diisopropylidene)dianiline, 4,4'-(p-phenylene diisopropylidene)dianiline, 2,2'-bis[4-(4-aminophenoxy)phenyl]propane, 4,4'-diaminobenzanilide, 4,4'-bis(4-aminophenoxy)biphenyl, m-xylene diamine, p-xylene diamine, 1,3,5-benzene triamine, and 1,3,5-benzene triaminomethyl.

An amount of the crosslinking agent is appropriately selected depending on the intended purpose without any limitation, which is within the skill of the ordinary artisan, but the amount thereof is preferably 0.05 parts by mass to 20 parts by mass, more preferably 0.1 parts by mass to 5 parts by mass, relative to 100 parts by mass of acrylic rubber.

When the amount of the crosslinking agent is 0.05 parts by mass to 20 parts by mass, crosslinking reaction is performed generally sufficiently, and therefore it may be easy to maintain a shape of the crosslinked product.

The acrylic rubber elastic layer may further contain a crosslink accelerator in combination with a crosslinking agent. The crosslink accelerator is appropriately selected depending on the intended purpose without any limitation, which is within the skill of the ordinary artisan, but it is preferably a crosslink accelerator that can be used in combination with the polyamine crosslinking agent.

Examples of such crosslink accelerator include a guanidine compound, an imidazole compound, a quaternary onium salt, a polyvalent tertiary amine compound, a tertiary phosphine compound, and a weak acid alkali metal salt. Mixtures can be used.

Examples of the guanidine compound include 1,3-diphenyl guanidine, and 1,3-diorthotolyl guanidine.

Examples of the imidazole compound include 2-methylimidazole, and 2-phenylimidazole.

Examples of the quaternary onium salt include tetra-n-butylammonium bromide, and octadecyl tri-n-butylammonium bromide.

Examples of the polyvalent tertiary amine compound include triethylene diamine, and 1,8-diazabicyclo[5.4.0]undec7-ene (DBU).

Examples of the tertiary phosphine compound include triphenyl phosphine, and tri-p-tolylphosphine.

Examples of the weak acid alkali metal salt include: inorganic weak acid salts such as phosphate and carbonate of sodium or potassium; and organic weak acid salts such as a stearic acid salt, and a lauric acid salt.

An amount of the crosslink accelerator is appropriately selected depending on the intended purpose without any limitation, which is within the skill of the ordinary artisan, but the amount thereof is preferably 0.1 parts by mass to 20 parts by mass, more preferably 0.3 parts by mass to 10 parts by mass, relative to 100 parts by mass of the acrylic rubber.

Use of the crosslink accelerator in an excessive amount may cause too fast crosslink speed during crosslinking, may cause blooming of the crosslink accelerator on a surface of the crosslinked product, or may result an excessively hard crosslink product. Use of the crosslink accelerator in an insufficient amount may significantly reduce tensile strength of a resulting crosslinked product, or may cause significant change in elongation or in tensile strength upon application of heat load.

—Other Components—

Other components are appropriately selected depending on the intended purpose without any limitation, such as an electrical resistance controlling agent, a fire-retardant, an antioxidant, a reinforcing agent, a bulking agent and a rubber accelerator. These may be used alone, or in combination.

A preparation method of the acrylic rubber is appropriately selected depending on the intended purpose without any limitation, which is within the skill of the ordinary artisan, but examples thereof include appropriate mixing methods, such as roll mixing, Banbury mixing, screw mixing, and solution mixing. The order for blending each ingredient is not particularly limited, but after sufficiently mixing components that are not easily reacted or decomposed with heat, for example, a crosslinking agent and the like can be mixed thereto as components that are easily reacted or decomposed with heat for a shot period at the temperature at which a reaction or decomposition will not occur.

The acrylic rubber can be formed into a crosslinked product by heating.

The heating temperature is appropriately selected depending on the intended purpose without any limitation, which is within the skill of the ordinary artisan, but the temperature is preferably 130° C. to 220° C., more preferably 140° C. to 200° C. The duration for crosslink is preferably 30 seconds to 5 hours.

The heating method is appropriately selected depending on the intended purpose without any limitation, which is within the skill of the ordinary artisan, and examples thereof include methods used for crosslink of rubbers, such as press heating, steam heating, oven heating, and hot air heating.

After performing a process for crosslink, a post crosslink process may be performed to make the inner part of the crosslinked product surely crosslinked. The duration for the post crosslink may vary depending on the heating method, crosslink temperature, and the shape of the product, but it is preferably 1 hour to 48 hours. The heating method and temperature for the post crosslink may be appropriately selected.

The flexibility of the elastic layer is appropriately selected depending on the intended purpose without any limitation, which is within the skill of the ordinary artisan, but it is preferably 40 or less in micro rubber hardness determined at 25° C., 50% RH. The micro rubber hardness can be measured by means of a commercial micro rubber hardness meter, for example, a micro rubber hardness meter MD-1, manufactured by KOBUNSHI KEIKI CO., LTD.

An average thickness of the elastic layer is appropriately selected depending on the intended purpose without any limitation, which is within the skill of the ordinary artisan, but it is preferably 200 μm to 600 μm, more preferably 300 μm to 500 μm. When the thickness of the center portion of the elastic layer is more than 200 μm, desirable image quality to types of paper having surface irregularities may be attained. When the thickness thereof is less than 600 μm, the weight of the elastic layer may be appropriate, which tends not to be bendy, causing stable running.

A thickness of the belt is the thickness in the absence of the spherical particles and the average value is calculated from 10 points of the measured values. Moreover, the thickness of the belt is measured by observing a cross-section surface of the belt under a scanning electron microscope (SEM "VE-7800" manufactured by KEYENCE CORPORATION).

<Spherical Particle>

The spherical particles include flexible particles and preferably also include hard particles.

—Flexible Particle—

The flexible particles have 0.1 MPa to 30 MPa of compressive strength, including 1, 3, 5, 7, 9, 12, 15, 17, 20, 22, 25, 27 MPa, and 15% to 50% of restoring ratio, including 20, 30 and 40%, at the time of 10% deformation. When the flexible particles have 0.1 MPa to 30 MPa of compressive strength and 15% to 50% of restoring ratio at the time of 10% deformation, it is difficult for the particles to detach at low-temperature and low-humidity (10° C. and 15% RH) and it attains development of durability.

The flexible particles are appropriately selected depending on the intended purpose without any limitation, which is within the skill of the ordinary artisan, but the flexible particles at least have 0.1 MPa to 30 MPa of compressive strength and 15% to 50% of restoring ratio at the time of 10% deformation. Non-limiting examples of such particles include an acrylate resin particle, a polyurethane resin particle, an ethylene-methyl methacrylate copolymer (EMMA) particle, and a low density polyethylene (LDPE) particle etc. These may be used alone, or in combination. Among these, especially an acrylate resin particle and a polyurethane resin particle are preferred in view of soft particles and high restoring ratio.

Compressive strength of the flexible particles at the time of 10% deformation is measured with, for example, a microcompression testing machine MCT (manufactured by SHIMAZU CORPORATION) on follow conditions. Besides, the spherical particles on the intermediate transfer belt are collected by scratching the surface of the belt with a lapping film.

When one particle is applied force (loading rate 0.98 mN/sec), the force is regarded as compressive strength (MPa) at 10% change of particle diameter.

—Measurement Conditions of Compressive Strength—

Temperature and Humidity: 23° C. and 15% RH
Pressure Indenter: 50 nm in diameter diamond indenter
Lower Pressure Board: SKS flat plate
Measure Mode: Unloading Test
Loading Rate: 0.98 mN/sec
Maximum Load: until 10% change of particle diameter Restoring ratio of the flexible particles is calculated by follow formula (1). Change of diameter of a particle is measured when the particle is loaded 9.8 mN and the load is reduced to 0.98 mN. Besides, the spherical particles on the intermediate transfer belt are collected by scratching the surface of the belt with a lapping film.

$$\text{Restoring ratio } \% = [\text{Change of diameter of a particle } (\mu m)/\text{diameter of a particle } (\mu m)] \times 100 \quad \text{Formula (1)}$$

—Measurement Conditions of Restoring Ratio—

Temperature and Humidity: 23° C. and 15% RH
Pressure Indenter: 50 μm in diameter diamond indenter
Lower Pressure Board: SKS flat plate
Measure Mode: Unloading Test
Loading Rate: 0.98 mN/sec
Maximum Load: 9.8 mN The flexible particles can be selected without any limitation from marketed product and appropriate compounds. Examples of the marketed products of polyurethane resin particles include "MELTEX" manufactured by SANYO CHEMICAL INDUSTRIES, Ltd., "DAIMICBEAZ UCN-8070CM CLEAR" manufactured by DAINICHISEIKA COLOR & CHEMICALS Mfg. Co., Ltd. and "Art-pearl" manufactured by Negami Chemical Industrial Co., Ltd. Example of the marketed products of an ethylene-methyl methacrylate copolymer (EMMA) particle includes "SOFTBEADS A" manufactured by SUMITOMO SEIKA CHEMICALS CO., LTD. Example of the marketed products of a low density polyethylene (LDPE) particle includes "LE-1080" manufactured by SUMITOMO SSEIKA CHEMICALS CO., LTD. Example of the marketed products of crosslinked polybutyl methacrylate particle includes "BM30X-5 manufactured by SEKISUI PLASTICS CO., LTD. Example of the marketed products of crosslinked polyacrylic ester particle includes "AFX-8 manufactured by SEKISUI PLASTICS CO., LTD. These may be used alone, or in combination.

An average particle diameter of the flexible particles (A2) is preferably 1.0 μm to 10 μm, including 2, 3, 4, 5, 6, 7, 8, and 9 μm. When the average particle diameter is 1.0 μm to 10 μm, toner transferability develops well. Besides, the flexible particles preferably have monodispersity. Monodispersity represents a sharp particle size distribution and in particular represents that distribution width is within a band of 50% either side of the average particle diameter.

The average particle diameter of the flexible particles (A2) can be measured by magnifying by 5,000 times with a scanning electron microscope (SEM "VE-7800" manufactured by KEYENCE CORPORATION). And the average particle diameter of the flexible particles (A2) is calculated from optional 10 points in view of the measured values.

—Hard Particle—

The hard particles are preferred to have beyond 30 MPa of compressive strength and less than 15% of restoring ratio at the time of 10% deformation.

When the hard particles have beyond 30 MPa of compressive strength and less than 15% of restoring ratio at the time of 10% deformation, toner transferability and cleaning ability at 30° C. and 85% RH develop well.

The compressive strength and the restoring ratio at the time of 10% deformation are measured in the same way as the flexible particles.

The hard particles are appropriately selected depending on the intended purpose without any limitation, which is within the skill of the ordinary artisan, but the hard particles at least have beyond 30 MPa of compressive strength (e.g., 40, 50, 60, 70, 80, 90 MPa, etc.) and less than 15% (e.g., 10, 5, 2, 0%) of restoring ratio at the time of 10% deformation. Examples of the hard particles include melamine resin, polyamide resin, polyester resin, silicone resin and fluorine resin. These may be used alone, or in combination. Among these, especially silicone resin and melamine resin are preferred.

The hard particles can be used from the commercially available products. Examples of the commercially available product include "TOSPEARL 2000B" and "TOSPEARL 1110" manufactured by Momentive Performance Materials Inc., and "EPOSTAR S21" and I POSTAR" manufactured by NIPPON SHOKUBAI CO., LTD.

The average particle diameter of the hard particles (B2) is preferably 1.0 μm to 15 μm, including 3, 5, 8, 10 and 12 μm. When the average particle diameter of the hard particles (B2) is 1.0 μm to 15 μm, good cleaning ability develops.

The hard particles are particles can be produced by any of the above resins and others by a polymerization method to give the shape as circular as possible, and in the hard particles for use in the present application are preferably very close to sphere. And the hard particles preferably have monodispersity. Monodispersity represents a sharp particle size distribution and in particular represents that distribution width is within a band of 50% either side of the average particle diameter. When the average particle diameter of the hard particles (B2) is more than 1.0 μm, toner transferability depending on the hard particles develops well. When the average particle diameter of the hard particles (B2) is not greater than 15 μm, distance between the hard particles become close and surface roughness become small to help attain good transferability. Besides, abnormal image due to cumulative charge potential at the time of continuously forming the image is inhibited.

The average particle diameter of the hard particles (B2) is measured in the same way as the average particle diameter of the flexible particles (A2).

A ratio of an average particle diameter of the flexible particles (A2) to an average particle diameter of the hard particles (B2) is preferably 0.8 to 10, including 2, 4, 6 and 8, more preferably 1.0 to 6.0. When the ratio (A2/B2) is more than 0.8, degradation of transferability at high-temperature and high-humidity can be inhibited. When the ratio (A2/B2) is not greater than 10, detachment of particles by sliding between edge of paper and the particles at low-temperature and low-humidity, and a longitudinal streak are inhibited.

A ratio of number of the flexible particles (A1) to number of the hard particles (B1) is preferably 4/1 to 1/4, more preferably 3/2 to 2/3.

When the ratio (A1/B1) is 4/1 to 1/4, detachment of particles at low-temperature and low-humidity is inhibited and transferability at high-temperature and high-humidity develops well.

The number of the flexible particles (A1) and the number of the hard particles (B1) is observed on the surface of the intermediate transfer belt with a laser microscope ("LEXT OLS-4100" manufactured by OLYMPUS CORPORATION) or a microscope ("VHX-5000" manufactured by KEYENCE CORPORATION) etc. The ratio (A1/B1) is calculated from (A1) and (B1).

The arrangement of spherical particles are appropriately selected depending on the intended purpose without any limitation, which is within the skill of the ordinary artisan. Examples of the arrangement of spherical particles include forming a layer of spherical particles in the thickness direction and forming 2 or more than layers of spherical particles in the thickness direction.

Forming the layer of spherical particles in the thickness direction is preferred because it is easy to order the spherical particles evenly by applying the spherical particles on the elastic layer and floating. As a result, stability high quality image can be maintained.

The present application has a configuration that the spherical particles are partially embedded in the exposed surface of the elastic layer. The embedding rate (%) thereof is preferably more than 50% but less than 100%, more preferably in the range of 51% to 90%. When the embedding rate thereof is 50% or less, the spherical particles may fall off from the belt during use in the image forming apparatus over a long period, and therefore the resulting belt has insufficient durability. When the embedding rate thereof is 100%, the effect of the spherical particles to contributing the transfer property of the belt is reduced and therefore it is not preferable.

The term "embedding rate" is a rate of a particle diameter of a spherical particle embedding in the elastic layer in the depth direction. The embedding rate used in the present specification does not mean that all of the spherical particles satisfy the embedding rate of more than 50% but less than 100%, but means that when it is seen from one visual field, the average embedding rate of the spherical particles within the visual field is more than 50% but less than 100%. Note that, when the embedding rate is 50%, particles completely embedded inside the elastic layer are rarely observed by a cross-sectional observation under an electron microscope.

Figure 4A:
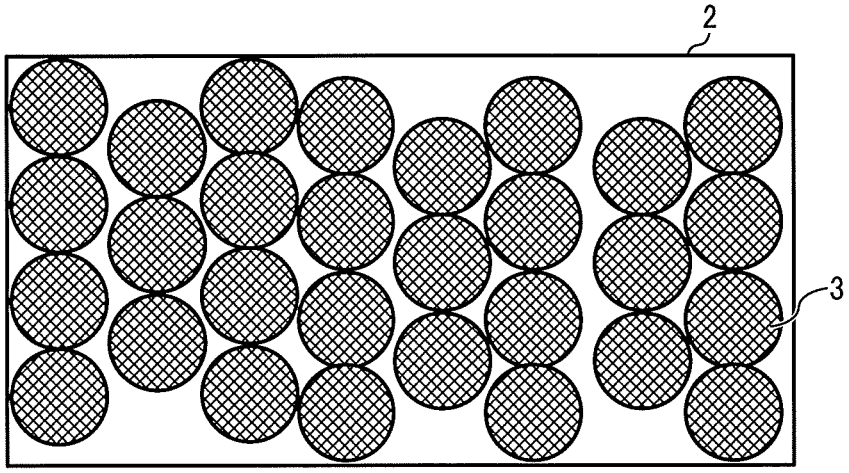
FIG. 4A is a schematic diagram illustrating one example of a surface configuration of the belt for an image forming apparatus of the present application.
Figure 4B:
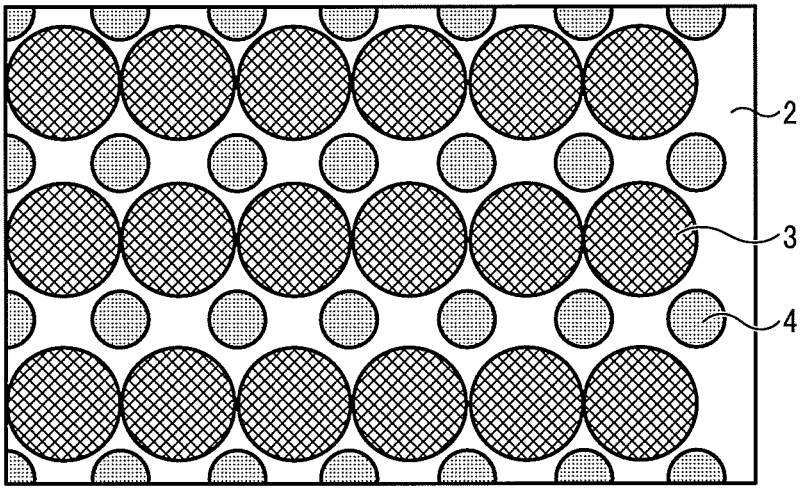
FIG. 4B is a schematic diagram illustrating another example of a surface configuration of the belt for an image forming apparatus of the present application.

FIG. 4A and FIG. 4B depict enlarged schematic diagrams observing the surface of the belt from the top. As illustrated in FIG. 4A and FIG. 4B, the embodiment of the belt includes the spherical particles having uniform particle diameters, which are each regularly aligned. There is rarely observed the spherical particles superimposed onto each other. The particles diameters of the spherical particles constituting the surface, provided on the exposed surface of the elastic layer, are preferably as uniform as possible, specifically preferably having the distribution width of ±(average particle diameter×0.5) μm.

Use of the spherical particles having particle diameters as uniform as possible is preferable to form the aforementioned alignment, but it is also acceptable that particles of certain particle diameters are selectively exposed to the surface to form the surface that achieve the aforementioned particle size distribution, without using the spherical particles of uniform particle diameters.

The rate of the spherical particles occupying the exposed surface of the elastic layer is preferably 60% or higher, including 65, 70, 75, 80, 85, 90%, etc. When the rate thereof is more than 60%, the exposed area of the material constituting the elastic layer is appropriate. As a result, desirable transfer property can be attained.

<Method for Producing Intermediate Transfer Belt>

One example of a method for producing the belt having the configuration of the present application will be explained next. First, a production method of the base layer will be explained.

A method for producing the base layer using, as a coating liquid containing at least a resin component, a coating liquid containing polyimide resin precursor or polyamide imide resin precursor will be explained.

A coating liquid containing at least a resin component (e.g., a coating liquid containing polyimide resin precursor or polyamide imide resin precursor) is applied onto a cylindrical mold, such as a cylindrical metal mold (e.g., a meta mold illustrated in FIG. 5), by a liquid supplying device, such as a nozzle and a dispenser, while slowly rotating the cylindrical mold, so as to uniformly coat and flow cast the outer surface of the cylindrical mold with the coating liquid, to thereby form a coating film. Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of about 80° C. to about 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 250° C. to about 450° C., to thereby sufficiently imidize the polyimide precursor or polyamide imidize the polyamide imide resin precursor. After sufficiently cooling the resulting film, an elastic layer will be sequentially laminated.

The elastic layer can be formed by applying a rubber coating liquid, which is prepared by dissolving rubber in an organic solvent, onto the base layer, followed by drying the solvent, and performing vulcanization. As for the coating method, likewise the formation of the base layer, conventional coating methods, such as spiral coating, die coating, and roll coating, can be used. Since a thickness of the elastic layer is preferably thick to improve convex-concave transfer property, die coating and spiral coating are excellent as a coating method for forming a thick film. The spiral coating is excellent as it can easily change the thickness of the elastic layer along the width direction as mentioned earlier. Accordingly, the method using spiral coating will be explained here.

First, a rubber coating liquid is spirally applied onto the base layer, while rotating the base layer in the circumferential direction, by continuously supplying the rubber coating liquid from a round or broad-line nozzle and moving the nozzle along the axial direction of the base layer. The coating liquid spirally applied onto the base layer is leveled and dried by maintaining the predetermined rotational speed and drying temperature. Thereafter, the resultant is subjected to vulcanization (crosslinking) at the predetermined vulcanizing temperature, to thereby form an elastic layer. To change a thickness along the width direction, an ejection amount of the nozzle may be changed, or a distance between the nozzle and the metal mold may be changed, or the rotational speed of the metal mold may be changed.

Figure 5:
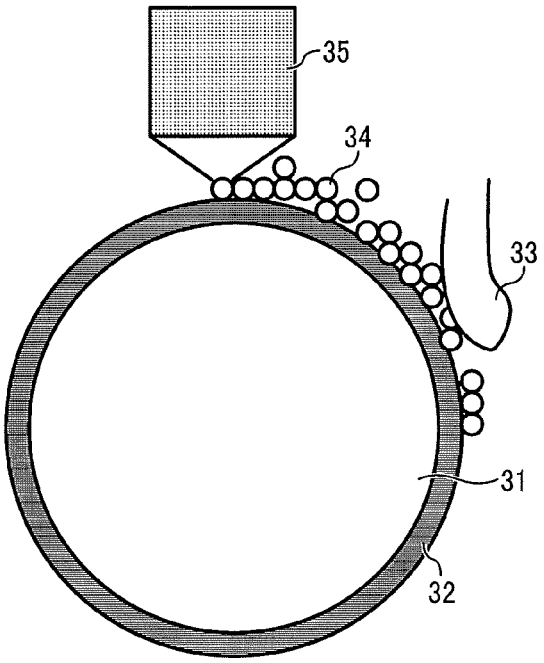
FIG. 5 is a schematic diagram explaining one example of the method for forming an elastic layer of the belt for an image forming apparatus of the present application, which has irregular surface configuration formed with spherical particles.

The vulcanized elastic layer is sufficiently cooled, followed by applying the spherical particles on the elastic layer and embedding the spherical particles therein to thereby produce a predetermined seamless belt (intermediate transfer belt) in which the spherical particles are partially embedded in the exposed surface of the elastic layer. The method for partially embedding the spherical particles in the exposed surface of the elastic layer includes, as illustrated in FIG. 5, providing a powder supplying device (35) and a pressing member (33), evenly applying spherical particles from the powder supplying device (35) to a surface of the elastic layer of the laminate containing the base layer and the elastic layer, while rotating the laminate, and pressing the spherical particles evenly spread on the surface with the pressing member (33) at constant pressure. The pressing member (33) removes excess spherical particles as well as embedding the spherical particles in the elastic layer. Especially in the case where monodisperse spherical particles are used, in accordance with the present application, the spherical particles can be evenly and partially embedded in the exposed surface of the elastic layer with a simple process consisting of leveling with the aforementioned pressing member.

A method for adjusting the embedding rate of the spherical particles in the exposed surface of the elastic layer is appropriately selected depending on the intended purpose without any limitation, and examples thereof include: a method for adjusting the embedding rate by adjusting the duration for pressing with the pressing member; and a method for adjusting the embedding rate by adjusting pressing force of the pressing member. In the case where the embedding rate is adjusted by adjusting the pressing force of the pressing member, the embedding rate of more than 50% but less than 100% can be relatively 1 to easily achieved by adjusting the pressing force to the range of 1 mN/cm to 1,000 mN/cm, for example with the flow cast coating liquid having the viscosity of 100 mPas to 100,000 mPas, although it depends on viscosity and solid content of the flow casting coating liquid, an amount of the solvent therein, and a material of the particles.

After evenly aligning the spherical particles on the surface, the laminate of the elastic layer and the base layer is heated at the predetermined temperature for the predetermined period while rotating, to thereby form the cured elastic layer in which the spherical particles have been embedded. After sufficiently cooling, the elastic layer together with the base layer is removed from the metal mold, to thereby obtain the predetermined seamless belt (intermediate transfer belt).

The method for measuring the embedding rate of the spherical particles is appropriately selected depending on the intended purpose without any limitation, which is within the skill of the ordinary artisan, and for example, it can be measured by observing a cross section of the belt under a scanning electronic microscope (SEM). The resistance of the thus produced belt is adjusted by varying an amount of the carbon black, or ion conductive agent. Attention should be paid during the adjustment of the resistance, as the resistant tends to be varied depending on the size of the particles or the occupying area rate. In the case where the belt is used as a seamless belt suitably equipped as an intermediate transfer belt, the electric resistance thereof is preferably $1\times10^{8}\Omega/\square$ to $1\times10^{13}\Omega/\square$ in the surface resistance, and $1\times10^{8}$ Ωcm to $1\times10^{11}$ Ωcm in the volume resistance. As for the measurement of the resistance, a commercially available measuring device can be used, and for example, the resistance can be measured by means of Hiresta, manufactured by Mitsubishi Chemical Analytech Co., Ltd.

Figure 6A:
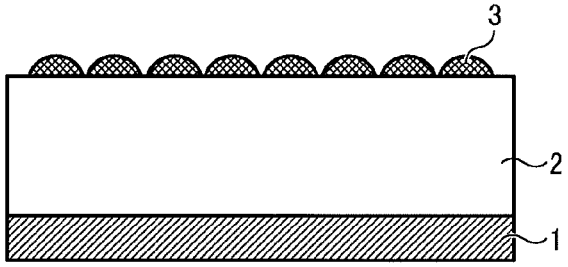
FIG. 6A is a diagram illustrating one example of a layer structure of the belt for an image forming apparatus of the present application.
Figure 6B:
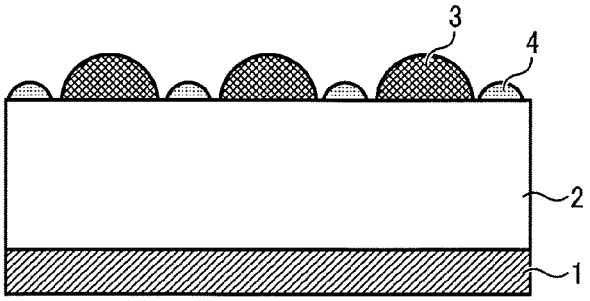
FIG. 6B is a diagram illustrating another example of a layer structure of the belt for an image forming apparatus of the present application.

FIG. 6A and FIG. 6B are a diagram illustrating one example of a layer structure of the belt for an image forming apparatus of the present application.

FIG. 6A and FIG. 6B depict a layer structure of an intermediate transfer belt, which is suitably used in the present application. The structure include a relatively bendable rigid base layer 1, a flexible elastic layer 2 laminated on the base layer 1, and at an outermost surface, spherical particles 3 are each separately aligned on the elastic layer 2 along its plane direction (spherical particles are embedded in the state where a top part of each particle is exposed) and are uniformly laminated in the convex-concave shape. The spherical particles 3 for use in the present application are rarely superimposed each other in a thickness direction of the elastic layer, or rarely embedded completely inside the elastic layer 2.

The intermediate transfer belt is preferably a seamless belt. Perimeter of the seamless belt is appropriately selected depending on the intended purpose without any limitation, but perimeter of the seamless belt is preferably more than 1,000 mm, more preferably 1,100 mm to 3,000 mm.

<Image Forming Apparatus and Image Forming Method>

The image forming apparatus of the present application contains an image bearing member configured to form a latent image thereon and bear a toner image thereon; a developing unit configured to develop the latent image formed on the image bearing member with a toner; an intermediate transfer belt configured to primary transfer thereon the toner image developed by the developing unit; and a transfer unit configured to secondary transfer the toner image on the intermediate transfer belt onto a recording medium. The image forming apparatus of the present application may contain appropriately selected other units.

The intermediate transfer belt is the intermediate transfer belt of the present application. The image forming apparatus is preferably full-color image forming apparatus having tandemly arranged image bearing members including each color developing unit.

The image forming method of the present application contains a developing step to develop the latent image formed on an image bearing member with a toner; a primary transferring step to transfer a toner image on an intermediate transfer belt and a secondary transferring step to transfer the toner image to a recording medium.

The image forming apparatus of the present application may contain appropriately selected other steps. The intermediate transfer belt is the intermediate transfer belt of the present application.

The seamless belt suitably used in a belt structure unit mounted in an image forming apparatus of the present application will be specifically explained hereinafter with reference to the main section schematic diagram. Note that, the schematic diagram illustrates one example, and shall not be construed as to limit the scope of the present application.

Figure 7:
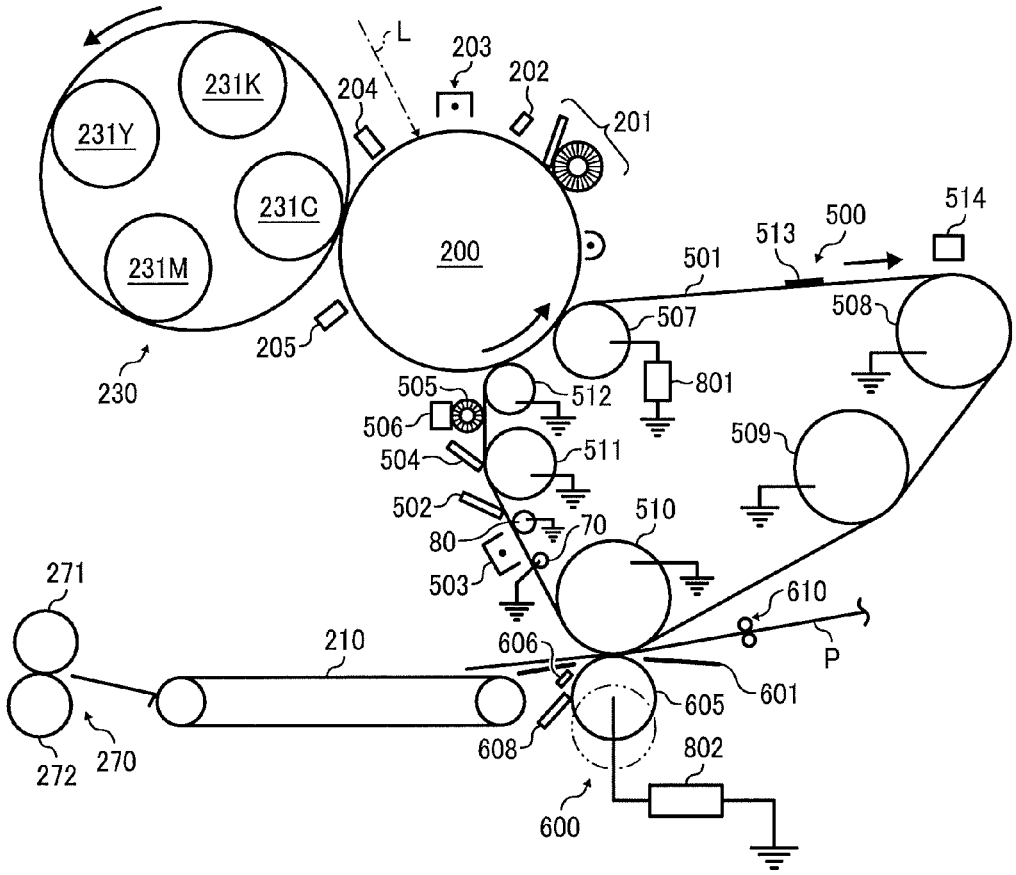
FIG. 7 is a schematic diagram of a main section, which illustrates one example of an image forming apparatus equipped with a seamless belt according to the present application.

The intermediate transfer unit (500) including the belt member of FIG. 7 include an intermediate transfer belt (501) provided across a plurality of rollers. In the surrounding area of the intermediate transfer belt (501), a secondary transfer bias roller (605), which is a secondary transfer charge applying unit of a secondary transfer unit (600), a belt cleaning blade (504), which is an intermediate transfer belt cleaning unit, and a lubricant applying brush (505), which is a lubricant applying member of a lubricant applying unit are provided so as to face the intermediate transfer belt (501).

Moreover, a position detecting mark (not illustrated) is provided on the outer surface or inner surface of the intermediate transfer belt (501). In the case where the position detecting mark is provided on the outer surface of the intermediate transfer belt (501), the position detecting mark needs to be provided to avoid the region where a belt cleaning blade (504) will pass through, which is sometimes difficult in view of the arrangements. In such case, the position detecting mark may be provided on the side of the inner surface of the intermediate transfer belt (501). An optical sensor (514) as a mark detecting sensor is provided in the position between a primary transfer bias roller (507), and a belt driving roller (508) around which the intermediate transfer belt (501) is provided.

The intermediate transfer belt (501) is provided across the primary transfer bias roller (507), which is a primary transfer charge applying unit, the belt driving roller (508), a belt tension roller (509), a secondary transfer counter roller (510), a cleaning counter roller (511), and a feed back current detecting roller (512). Each roller is formed of an electric conductive material, and all of the rollers, exclusive of the primary transfer bias roller (507), are earthed. To the primary transfer bias roller (507), transfer bias whose current or voltage is controlled to have a certain value depending on the number of toner images superimposed is applied from a primary transfer power source (801) which is controlled to provide constant current or constant voltage.

The intermediate transfer belt (501) is driven to rotate in the direction shown with the arrow by a belt driving roller (508) that is driven to rotate in the direction shown with the arrow by a driving motor (not illustrated).

The belt member, the intermediate transfer belt (501), is typically a semiconductor or insulator, and has a single layer or multilayer structure. In the preferable embodiment of the present application, a seamless belt is preferably used, and using the seamless belt as the intermediate transfer belt enables to improve the durability of the intermediate transfer belt, as well as realizing excellent image formation. Moreover, the intermediate transfer belt is designed to have a size larger than the maximum size for feedable paper so that toner images formed on a photoconductor drum (200) can be superimposed thereon.

The secondary transfer bias roller (605), which is a secondary transfer unit, is mounted detachable to the area in the outer surface of the intermediate transfer belt (501) where it is supported around the secondary transfer counter roller (510), by a separation system serving as the below-mentioned moving unit. The secondary transfer bias roller (605) is mounted so as to nip a recording paper with the area of the intermediate transfer belt (501) where it is supported around the secondary transfer counter roller (510). To the secondary transfer bias roller (605), transfer bias of the predetermined current is applied from the secondary transfer power source (802) which is controlled to provide constant current.

The registration rollers (610) are configured to send the transfer paper (P), which is a transfer member, between the secondary transfer bias roller (605) and the intermediate transfer belt (501) supported by the secondary transfer counter roller (510), with the predetermined timing. Moreover, a cleaning blade (608), which is a cleaning unit, is brought into contact with the secondary transfer bias roller (605). The cleaning blade (608) is configured to remove the depositions deposited on the surface of the secondary transfer bias roller (605) to thereby clean the secondary transfer bias roller (605).

Once an image formation cycle is started in the color photocopier of the aforementioned structure, the photoconductor drum (200) is rotated in the anticlockwise direction shown with the arrow by the driving motor (not illustrated), and operations are performed to form a black (Bk) toner image, a cyan (C) toner image, a magenta (M) toner image, and a yellow (Y) toner image on the photoconductor drum (200). The intermediate transfer belt (501) is rotated in the clockwise direction shown with the arrow by the belt driving roller (508).

Along the rotation of the intermediate transfer belt (501), primary transfer of the Bk toner image, the C toner image, the M toner image, and the Y toner image are performed by transfer bias generated by the voltage applied to the primary transfer bias roller (507), and ultimately each of the toner images are superimposed and formed in the order of Bk, C, M, and Y on the intermediate transfer belt (501).

For example, the formation of the Bk toner image is carried out in the following manner.

In FIG. 7, a charger (203) uniformly charges the surface of the photoconductor drum (200) with the negative charge of the predetermined electric potential by corona discharge. Based on the belt mark detecting signal, the timing for the operation is determined, and ruster exposure is carried out with laser light (L) by means of a writing optical unit (not illustrated) based on the Bk color image signal. When the ruster image is formed by the exposure, the exposed area of the initially uniformly charged surface of the photoconductor drum (200) loses its electric charge in the amount proportional to the exposure value, to thereby form a Bk latent electrostatic image. By bringing the negatively charged Bk toner on a developing roller of the Bk developing unit (231Bk) into contact with the Bk latent electrostatic image, the toner is adsorbed on the area of the photoconductor drum (200) where there is not electric charge, that is the exposed area, without depositing the toner on the area where the electric charge remains, to thereby form a Bk toner image identical to the latent electrostatic image.

The Bk toner image formed on the photoconductor drum (200) in the aforementioned manner is primary transferred to the outer surface of the intermediate transfer belt (501) which is driven to rotate at the same speed to the rotational speed of the photoconductor drum (200) in the state that it is in contact with the photoconductor drum (200). After the primary transferring, a small amount of the toner remained on the surface of the photoconductor drum (200) without being transferred is cleaned by a photoconductor cleaning device (201) to thereby be recovered and re-used for the photoconductor drum (200). After the formation of the Bk image, the photoconductor drum (200) proceeds to the operation for a C image formation. The color scanner starts reading the C image data with the predetermined timing, and a C latent electrostatic image is formed on the surface of the photoconductor drum (200) by writing the C image data with laser light.

After the rear edge of the Bk latent electrostatic image is passed through and before the top edge of the C latent electrostatic image reaches, a revolver developing unit (230) is revolved to set the C developing unit (231C) in the developing position, and the C latent electrostatic image is developed with the C toner. Thereafter, the region of the C latent electrostatic image is continued to be developed. When the rear edge of the C latent electrostatic image is passed through, however, the revolver developing unit is revolved in the same manner in the case of the aforementioned K developing unit (231K), to move the M developing unit (231M) into the developing position. This operation is completed, as in the manner mentioned above, before the top edge of the next Y latent electrostatic image reaches. The explanations of operations for M image formation and Y image formation are omitted here because the operations of color image reading, latent electrostatic formation, and developing are the same to those of Bk, and C.

The Bk, C, M, and Y toner images sequentially formed on the photoconductor drum (200) in the aforementioned manner are sequentially positioned and primary transferred on the identical surface of the intermediate transfer belt (501). As a result, a toner image, in which at maximum, four colors are superimposed, is formed on the intermediate transfer belt (501). Meanwhile, with the timing of starting the operation of the image formation, the transfer paper P is fed from the paper feeding unit, such as a transfer paper cassette and a manual feeding tray, and is stood by at the nip between the registration rollers (610).

When the top edge of the toner image on the intermediate transfer belt (501) comes to a secondary transfer section formed with a nip between the intermediate transfer belt (501) supported by the secondary transfer counter roller (510) and the secondary transfer bias roller (605), the registration rollers (610) are driven to transfer the transfer paper along the transfer paper guide plate (601) in the manner that the top edge of the transfer paper (P) meets the top edge of the toner image, to thereby perform the registration of the transfer paper (P) with the toner image.

Once the transfer paper (P) reaches the secondary transfer section in the manner described above, the four-color superimposed toner images on the intermediate transfer belt (501) are collectively transferred (secondary transferred) onto the transfer paper (P) by transfer bias generated by the voltage applied to the secondary transfer bias roller (605) by the secondary transfer power source (802). The transfer paper is then transported along the transfer paper guide plate (601), and is diselectrified by passing the area facing to the transfer paper diselectrification charger (606) formed of a diselectrification needle, disposed in the downstream of the secondary transfer section, followed by transported towards a fixing device (270) by a belt conveying device (210), which is a belt element structure unit. Thereafter, the toner image on the transfer paper (P) is fused and fixed thereon at the nip between the fixing rollers (271), (272) of the fixing device (270), followed by sending out the transfer paper (P) from the device main body by discharging roller (not illustrated) to be stacked on a copy tray (not illustrated) with the top side up. Note that, the fixing device (270) optionally has a belt structure unit, if necessary.

Meanwhile, the surface of the photoconductor drum (200) after the belt transferring is cleaned by the photoconductor cleaning device (201), and is uniformly diselectrified by the diselectrification lamp (202). Moreover, the residual toner on the outer surface of the intermediate transfer belt (501) after secondary transferring the toner images on the transfer paper (P) is cleaned by a belt cleaning blade (504). The belt cleaning blade (504) is designed to come into contact with the outer surface of the intermediate transfer belt (501) with the predetermined timing by means of a cleaning member moving unit, which is not illustrated in the drawing.

At the upstream of the belt cleaning blade (504) in the traveling direction of the intermediate transfer belt (501), a toner sealing member (502) coming in contact with and moving away from the outer surface of the intermediate transfer belt (501) is provided. The toner sealing member (502) receives the toner fell off from the belt cleaning blade (504) during the cleaning of the residual toner, to thereby prevent the fallen toner from scattering onto the transporting path of the transfer paper (P). The toner sealing member (502) is brought into contact with or moved away from the outer surface of the intermediate transfer belt (501) by means of the cleaning member moving unit, together with the belt cleaning blade (504).

To the outer surface of the intermediate transfer belt (501) from which the residual toner has been removed in the aforementioned manner, a lubricant (506) is applied by a lubricant applying brush (505). The lubricant (506) is formed of a solid, such as zinc stearate, and is provided so as to be in contact with the lubricant applying brush (505), Moreover, the residual charge remained on the outer surface of the intermediate transfer belt (501) is eliminated by diselectrification bias applied by a belt diselectrification brush, which is not illustrated, and is provided to be in contact with the outer surface of the intermediate transfer belt (501).

Here, the lubricant applying brush (505) and the belt diselectrification brush are each designed to come into contact with and move away from the circumferential surface of the intermediate transfer belt (501) with the predetermined timing, by means of a moving unit not illustrated in the drawing.

In the case of repeated photocopying, as for the operations of the color scanner and the image formation on the photoconductor drum (200), the image forming operation of the first color (Bk) for the second sheet starts with the predetermined timing following to the image forming operation of the fourth color (Y) for the first sheet. Moreover, following to the operation for collectively transferring the superimposed four color toner images for the first sheet, the intermediate transfer belt (501) receives the Bk toner image for the second sheet, which is primary transferred, with the region of the circumferential surface thereof where cleaning has been performed with the belt cleaning blade (504). The same operation to that for the first sheet is performed thereafter. The explained above is a copy mode to give a four color full-color copy, but in case of a three color copy mode or two color copy mode, the same operations to the above are performed according to the designated colors and rotations. In the case of a monocolor copy mode, only the developing device of the predetermined color of the revolver developing unit (230) is driven in the developing operation state before copying of the predetermined number of sheets is completed, and the copying operation is performed with the belt cleaning blade (504) remaining in contact with the intermediate transfer belt (501).

In FIG. 7, the numeral reference 70 denotes a diselectrification 15s roller, the numeral reference 80 denotes an earth roller, the numeral reference 204 denotes an electric potential sensor, the numeral reference 205 denotes a toner image density sensor, the numeral reference 503 denotes a charger, and the numeral reference 513 denotes a toner image.

Figure 8:
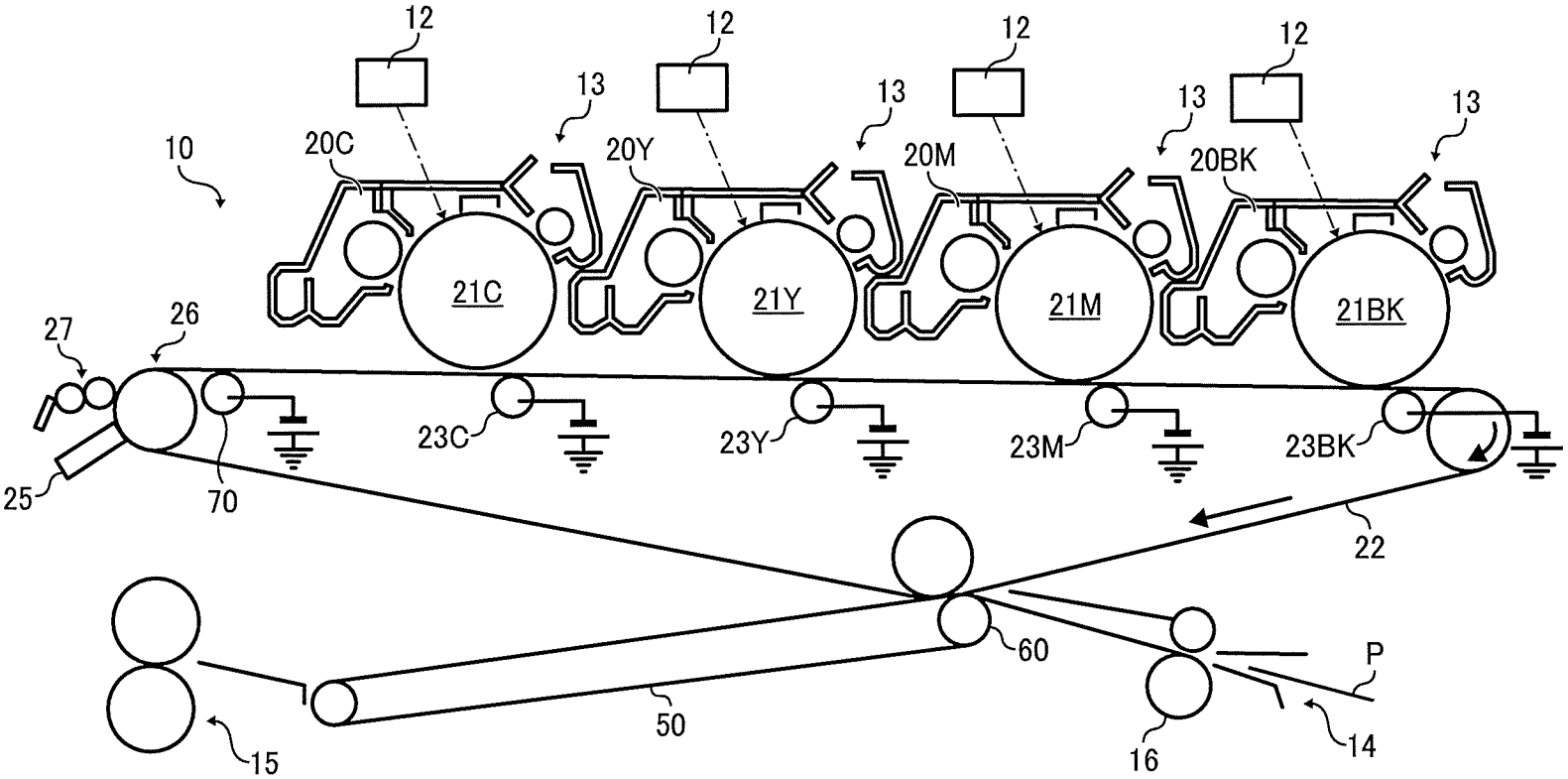
FIG. 8 is a schematic diagram of a main section, which illustrates another example of an image forming apparatus equipped with a seamless belt according to the present application.

Although the photocopier equipped with only one photoconductor drum has been explained in the embodiment above, the present application can be also applied for an image forming apparatus in which a plurality of photoconductor drums are aligned and provided along one intermediate transfer belt formed of a seamless belt, for example, as illustrated in FIG. 8 of the main section schematic diagram.

FIG. 8 illustrates one configuration example of a four-drum digital color copier equipped with four photoconductor drums (21BK), (21Y), (21M), (21C) for forming toner images of four different colors (black, yellow, magenta, and cyan).

In FIG. 8, the printer main body (10) is equipped with an image writing unit (12), an image forming unit (13), and a paper feeding unit (14), all of which are for performing color image formation by electrophotography. Image processing is performed by an image processing unit based on the image signal to convert into signals for each color black (BK), magenta (M), yellow (Y), cyan (C) for image forming, and the resulting signals are sent to the image writing unit (12). The image writing unit (12) is a scanning optical system, for example, constituted of a laser light source, a deflector such as a rotating polygon mirror, a scanning imagery optical system, and a group of mirrors, and has four wiring optical paths each corresponding to a respective color signal. The image writing unit (12) writes on each of the image bearing members (photoconductors) (21BK), (21M), (21Y), (21C), which are image bearing members each provided for a respective color in the image forming unit (13), corresponding to each color signal.

The image forming unit (13) is equipped with the photoconductors (21BK), (21M), (21Y), (21C), which are image bearing members for black (BK), magenta (M), yellow (Y), and cyan (C), respectively.

As for each photoconductor of each color, an OPC photoconductor is generally used. In the surrounding area of each of the photoconductors (21BK), (21M), (21Y), (21C), a charging device, a section exposed to laser light emitted from the image wiring unit (12), a developing device (20BK), (20M), (20Y), or (20C) of a respective color, black, magenta, yellow or cyan, a primary transfer bias roller (23BK), (23M), (23Y) or (23C) as a primary transferring unit, a cleaning device to (not illustrated), and a photoconductor diselectrification device (not illustrated) are provided. Note that, the developing devices (20BK), (20M), (20Y), (20C) apply a two-component magnetic brush developing system. The intermediate transfer belt (22), which is a belt element, is present between each of the photoconductors (21BK), (21M), (21Y), (21C) and each of the primary transfer bias rollers (23BK), (23M), (23Y), (23C), and the toner image of each color formed on a respective photoconductor is successively superimposed and transferred.

Meanwhile, the transfer paper (P) is borne with the transfer conveying belt (50), which is a belt component, via the registration rollers (16), after fed from a paper feeding unit (14). At the position where the intermediate transfer belt (22) is in contact with the transfer conveying belt (50), the toner images transferred onto the intermediate transfer belt (22) are secondary transferred (correctively transferred) to the transfer paper (P) by a secondary transfer bias roller (60) serving as the secondary transferring unit. In the manner as mentioned above, a color image is formed on the transfer paper (P).

The transfer paper (P) on which the color image has been formed is transported to the fixing device (15) by the transfer conveying belt (50), and the transferred image is fixed by the fixing device (15), followed by discharging the transfer paper (P) from the printer main body.

Note that, the residual toner remained on the intermediate transfer belt (22) without being transferred at the time of the secondary transfer is removed from the intermediate transfer belt (22) by the belt cleaning member (25).

At the downstream side of the belt cleaning member (25), a lubricant applying device (27) is provided. The lubricant coating device (27) contains a solid lubricant, and an electric conductive brush configured to apply the solid lubricant by rubbing the solid lubricant with the intermediate transfer belt (22). The electric conductive brush is always in contact with the intermediate transfer belt (22) to apply the solid lubricant to the intermediate transfer belt (22). The solid lubricant has functions of enhancing cleaning ability of the intermediate transfer belt (22), and preventing occurrences of filming to improve the durability.

In FIG. 8, the numeral reference 26 denotes a driving roller, and the numeral reference 70 denotes a diselectrification roller.

EXAMPLES

The present application will be more specifically explained based upon Examples hereinafter, but the present application shall not be construed as limited to these Examples.

<Compressive Strength of the Spherical Particles at the Time of 10% Deformation>

Compressive strength of the spherical particles at the time of 10% deformation was measured with, for example, a microcompression testing machine MCT (manufactured by SHIMAZU CORPORATION) on follow conditions. Besides, the spherical particles on the intermediate transfer belt were collected by scratching the surface of the belt with a lapping film.

When one particle was applied force (loading rate 0.98 mN/sec), the force was regarded as compressive strength (MPa) at 10% change of particle diameter.

—Measurement Conditions of Compressive Strength—

Temperature and Humidity: 23° C. and 15% RH

Pressure Indenter: 50 μm in diameter diamond indenter

Lower Pressure Board: SKS flat plate

Measure Mode: Unloading Test

Loading Rate: 0.98 mN/sec

Maximum Load: until 10% change of particle diameter

<Restoring Ratio of the Spherical Particles at the Time of 10% Deformation>

Restoring ratio of the spherical particles was calculated by follow formula (1). Change of diameter of a particle was measured when the particle is loaded 9.8 mN and the load was reduced to 0.98 mN. Besides, the spherical particles on the intermediate transfer belt were collected by scratching the surface of the belt with a lapping film.

$$\text{Restoring ratio \%}=[\text{Change of diameter of a particle (}\mu\text{m)/diameter of a particle (}\mu\text{m)}]\times 100 \quad \text{Formula (1)}$$

—Measurement Conditions of Restoring Ratio—

Temperature and Humidity: 23° C. and 15% RH

Pressure Indenter: 50 μm in diameter diamond indenter

Lower Pressure Board: SKS flat plate

Measure Mode: Unloading Test

Loading Rate: 0.98 mN/sec

Maximum Load: 9.8 mN

<The Average Particle Diameter of the Spherical Particles>

The average particle diameter of the spherical particles was measured by magnifying by 5,000 times with a scanning electron microscope (SEM "VE-7800" manufactured by KEYENCE CORPORATION). And the average particle diameter of the spherical particles was calculated from optional 10 points in view of the measured values.

<Measurement Method of the Ratio (A1/B1)>

The number of the flexible particles (A1) and the number of the hard particles (B1) is observed on the surface of the intermediate transfer belt with a laser microscope ("LEXT OLS-4100" manufactured by OLYMPUS CORPORATION) or a microscope ("VHX-5000" manufactured by KEYENCE CORPORATION) etc. The ratio (A1/B1) is calculated from (A1) and (B1).

<Shape of Spherical Particles>

Figure 2:
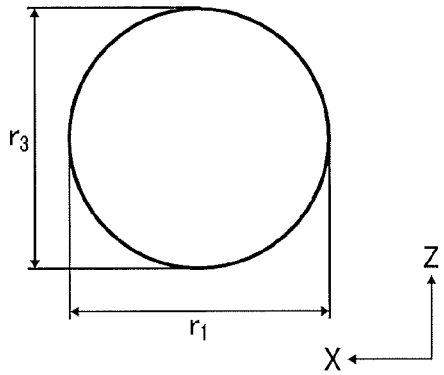
FIG. 2 is a schematic view illustrating a shape of a spherical particle of the present application.
Figure 3:
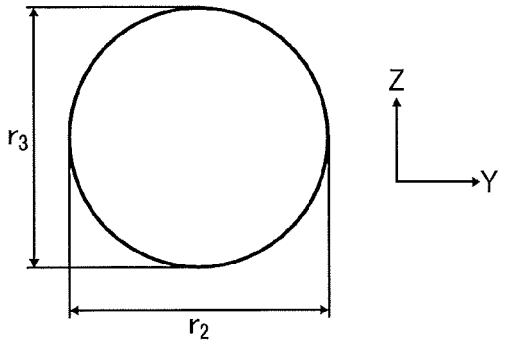
FIG. 3 is a schematic view illustrating a shape of a spherical particle of the present application.

Spherical particles (flexible particles and hard particles) were adhered to smooth surface and 100 spherical particles were observed with color laser microscope "VK-8500" (manufactured by KEYENCE CORPORATION) by optional magnification ratio (for example 1,000 times). As shown in FIG. 1, FIG. 2 and FIG. 3, long axes (r1 μm), short axes (r2 μm) and thickness (r3 μm) of 100 spherical particles were measured, followed by calculating averages. Particles having 0.9 to 1.0 of a ratio (r2/r1) and 0.9 to 1.0 of a ratio (r3/r2) were regarded as spherical particles.

Example 1

(Preparation of Base Layer Coating Liquid)

First, a dispersion liquid preferred in advance by dispersing in N-methyl-2-pyrrolidone, carbon black (Special Black 4, manufactured by Evonik Degussa Japan Co., Ltd.) by means of a bead mill was blended to polyimide varnish (U-varnish A, manufactured by Ube Industries, Ltd.) containing polyimide resin precursor (polyamic acid) as a main component so that the carbon black content became 17% by mass of the polyamic acid solid content. The resultant was sufficiently stirred and mixture to thereby prepare a coating liquid.

(Production of Polyimide Base Layer Belt)

Next, a metal cylindrical support having an outer diameter of 500 mm and a length of 400 mm, surface of which had been roughened by a blast treatment, was used as a mold, and was mounted in a roll coating device.

Subsequently, Base Layer Coating Liquid A was poured into a pan, the coating liquid was scoped with a coating roller having a rotational speed of 40 mm/sec. A thickness of the coating liquid on the coating roller was controlled by setting a gap between a regulating roller and the coating roller to 0.6 mm.

Thereafter, the rotational speed of the cylindrical support was controlled at 35 mm/sec, and was brought close to the coating roller. Setting the gap between the cylindrical support and the coating roller to 0.4 mm, the coating liquid on the coating roller was uniformly transferred and coated on the cylindrical support. While maintaining the rotation of the cylindrical support, the cylindrical support on which the coating liquid had been applied was introduced into a hot air circulating dryer to gradually increase the temperature to 110° C., and heated the applied coating liquid for 30 minutes. The temperature was further increased to 200° C. and heated at the same temperature for 30 minutes, followed by stopping the rotation. Thereafter, the resultant was introduced into a heating furnace capable of performing a high temperature treatment (baking furnace), and the temperature was increased stepwise up to 320° C. to perform heating (baking) for 60 minutes. The resultant was then sufficiently cooled, to produce Polyimide Base Layer Belt A having a thickness of 60 μm.

(Production of Elastic Layer onto Polyimide Base Layer Belt)

Below ingredients were blended with a blending ratio, and the resultant was kneaded to thereby produce a rubber composition.

Acrylic rubber (Nipol AR12, ZEON 100 parts by mass CORPORATION)

Stearic acid (beads stearic acid Tsubaki, NOF 1 part by mass Corporation)

Red phosphorous (Nova Excel 140F, Rinkagaku 10 parts by mass Kogyo Co., Ltd.)

Aluminum hydroxide (HIGILITE H42M, 40 parts by mass manufactured by Showa Denko K.K.)

Crosslink agent (Diak No. 1 (hexamethylene 0.6 parts by mass diamine carbamate), manufactured by DuPont Dow Elastomers Japan)

Crosslink agent (VULCOFAC ACT55 (70% by 0.6 parts by mass of a salt of 1,8-diazabicyclo(5,4,0)undec-7-ene and dibasic acid, 30% by mass of amorphous silica), manufactured by Safic-Alcan)

Electric conductive agent (QAP-01 0.3 parts by mass (tetrabutylammonium perchlorate), manufactured by Japan Carlit Co., Ltd.)

Next, the thus obtained rubber composition was dissolved in an organic solvent (methyl isobutyl ketone, MIBk) to thereby prepare a rubber solution having a solid content of 35% by mass. While rotating the cylindrical support on which the polyimide base layer had been produced, the prepared rubber solution was spirally applied onto the polyimide base layer by continuously ejecting the rubber solution from a nozzle and moving the nozzle along the axial direction of the support.

The coating amount was controlled to an amount with which a final thickness of the center portion of the belt became 400 μm. Thereafter, the cylindrical support on which the rubber coating solution had been coated was introduced into a hot air circulating dryer white keep rotating the cylindrical support. The temperature was increased to 90° C. at the rating rate of 4° C./min. and heated at 90° C. for 30 minutes.

—Applying Particles to the Surface of the Elastic Layer—

Thereafter, the resultant was taken out from the dryer and was cooled. In accordance with the method illustrated in FIG. 5, as polyurethane spherical particles ("DAIMICBEAZ UCN-8070CM CLEAR" average particle diameter; 7 μm manufactured by DAINICHISEIKA COLOR & CHEMICALS Mfg. Co., Ltd.) were evenly spread over a surface of the cooled rubber coating (an elastic layer), and a pressing member, which was a polyurethane blade ("T7050" manufactured by TOYO TIRE & RUBBER CO., LTD.), was pressed against the surface of the elastic layer at pressing force of 100 mN/cm, to thereby fix the spherical particles in the elastic layer.

Subsequently, the resultant was again introduced into a hot air circulating dryer, and subjected to a heat treatment for 60 minutes by heating to 170° C. at the heating rate of 4° C./min, to thereby obtain Intermediate Transfer Belt A.

Compressive strength of the intermediate transfer belt A was 3.6 MPa. Restoring ratio of the intermediate transfer belt A was 42.5%.

Example 2

An intermediate transfer belt B of Example 2 was obtained in the same manner as in Example 1 except that polyurethane resin as spherical particles of Example 1 was changed to crosslinked polybutyl methacrylate particle ("BM30X-5" average particle diameter; 5 μm manufactured by SEKISUI PLASTICS CO., LTD.).

Compressive strength of the intermediate transfer belt B was 18.9 MPa. Restoring ratio of the intermediate transfer belt B was 19.7%.

Example 3

An intermediate transfer belt C of Example 1 was obtained in the same manner as in Example 1 except that polyurethane resin as spherical particles of Example 1 was changed to crosslinked polyacrylic ester particle ("AFX-8" average particle diameter; 8 μm manufactured by SEKISUI PLASTICS CO., LTD.).

Compressive strength of the intermediate transfer belt C was 11.5 MPa. Restoring ratio of the intermediate transfer belt C was 24.6%.

Example 4

An intermediate transfer belt D of Example 4 was obtained in the same manner as in Example 1 except that polyurethane resin as spherical particles of Example 1 was changed to a low density polyethylene particle ("LE-1080" average particle diameter; 6 μm manufactured by SUMITOMO SEIKA CHEMICALS CO., LTD.).

Compressive strength of the intermediate transfer belt D was 25.6 MPa. Restoring ratio of the intermediate transfer belt D was 17.5%.

Example 5

An intermediate transfer belt E of Example 5 was obtained in the same manner as in Example 1 except that polyurethane resin as spherical particles of Example 1 was changed to an ethylene-methyl methacrylate copolymer (EMMA) particle ("SOFTBEADS A" average particle diameter; 10 μm manufactured by SUMITOMO SEIKA CHEMICALS CO., LTD.).

Compressive strength of the intermediate transfer belt E was 28.3 MPa. Restoring ratio of the intermediate transfer belt E was 15.5%.

Example 6

An intermediate transfer belt F of Example 6 was obtained in the same manner as in Example 1 except that spherical particles of Example 1 was changed to the follow.

The polyurethane flexible particles ("DAIMICBEAZ UCN-8070CM CLEAR" average particle diameter; 7 μm manufactured by DAINICHISEIKA COLOR & CHEMICALS Mfg. Co., Ltd.) and the melamine hard particles ("EPOSTAR S21" average particle diameter; 1.2 μm manufactured by NIPPON SHOKUBAI CO, LTD.) were mixed by 1/1 of a blend ratio. The mixture were evenly spread over a surface of the cooled rubber coating (an elastic layer), and a pressing member, which was a polyurethane blade ("T7050" manufactured by TOYO TIRE & RUBBER CO., LTD.), was pressed against the surface of the elastic layer at pressing force of 100 mN/cm, to thereby fix the spherical particles in the elastic layer.

Subsequently, the resultant was again introduced into a hot air circulating dryer, and subjected to a heat treatment for 60 minutes by heating to 170° C. at the heating rate of 4° C./min, to thereby obtain Intermediate Transfer Belt F. The ratio (A1/B1) of number of the flexible particles (A1) to number of the hard particles (B1) on the obtained Intermediate Transfer Belt F was confirmed 1/1 as with the blend ratio.

Compressive strength of the polyurethane flexible particles on the intermediate transfer belt F was 3.6 MPa. Restoring ratio of the polyurethane flexible particles on the intermediate transfer belt F was 42.5%. And compressive strength of the melamine hard particles on the intermediate transfer belt F was 53.9 MPa. Restoring ratio of the melamine hard particles on the intermediate transfer belt F was 6.1%.

Example 7

An intermediate transfer belt G of Example 7 was obtained in the same manner as in Example 6 except that melamine resin as hard particles of Example 6 was changed to silicone resin hard particles ("TOSPEARL 2000B" average particle diameter; 6 μm manufactured by Momentive Performance Materials Inc.,).

Compressive strength of the polyurethane flexible particles on the intermediate transfer belt F was 3.6 MPa. Restoring ratio of the polyurethane flexible particles on the intermediate transfer belt F was 42.5%. And compressive strength of the silicone hard particles on the intermediate transfer belt F was 42.1 MPa. Restoring ratio of the silicone hard particles on the intermediate transfer belt F was 4.5%.

Example 8

An intermediate transfer belt H of Example 8 was obtained in the same manner as in Example 6 except that melamine resin as hard particles of Example 6 was changed to silicone resin hard particles ("TOSPEARL 1110" manufactured by Momentive Performance Materials Inc.,).

Compressive strength of the polyurethane flexible particles on the intermediate transfer belt F was 3.6 MPa. Restoring ratio of the polyurethane flexible particles on the intermediate transfer belt F was 42.5%. And compressive strength of the silicone hard particles on the intermediate transfer belt H was 43.5 MPa. Restoring ratio of the silicone hard particles on the intermediate transfer belt H was 3.9%.

Example 9

An intermediate transfer belt I of Example 9 was obtained in the same manner as in Example 6 except that polyurethane resin as flexible particles of Example 6 was changed to an ethylene-methyl methacrylate copolymer (EMMA) particle ("SOFTBEADS A" average particle diameter; 10 μm manufactured by SUMITOMO SEIKA CHEMICALS CO., LTD.).

Compressive strength of the polyurethane flexible particles on the intermediate transfer belt F was 28.3 MPa. Restoring ratio of the polyurethane flexible particles on the intermediate transfer belt F was 15.5%. And compressive strength of the melamine hard particles on the intermediate transfer belt I was 53.9 MPa. Restoring ratio of the melamine hard particles on the intermediate transfer belt I was 6.1%.

Example 10

An intermediate transfer belt J of Example 10 was obtained in the same manner as in Example 6 except that the blend ratio of Example 6 was changed to 9/1. The ratio (A1/B1) of number of the flexible particles (A1) to number of the hard particles (B1) on the obtained Intermediate Transfer Belt F was confirmed 9/1 as with the blend ratio.

Example 11

An intermediate transfer belt K of Example 11 was obtained in the same manner as in Example 6 except that the blend ratio of Example 6 was changed to 1/9. The ratio (A1/B1) of number of the flexible particles (A1) to number of the hard particles (B1) on the obtained Intermediate Transfer Belt F was confirmed 1/9 as with the blend ratio.

Comparative Example 1

An intermediate transfer belt L of Comparative Example 1 was obtained in the same manner as in Example 1 except that polyurethane resin as flexible spherical particles of Example 1 was changed to silicone resin hard particles ("TOSPEARL 2000B" average particle diameter; 6 μm manufactured by Momentive Performance Materials Inc.).

Compressive strength of the intermediate transfer belt L was 42.1 MPa. Restoring ratio of the intermediate transfer belt L was 4.5%.

Comparative Example 2

An intermediate transfer belt M of Comparative Example 2 was obtained in the same manner as in Example 1 except that polyurethane resin as flexible spherical particles of Example 1 was changed to melamine resin hard particles ("OPTBEADS6500M" average particle diameter; 6.5 μm manufactured by NISSAN CHEMICAL INDUSTRIES, LTD.).

Compressive strength of the intermediate transfer belt M was 58.2 MPa. Restoring ratio of the intermediate transfer belt M was 7.7%.

Comparative Example 3

An intermediate transfer belt N of Comparative Example 3 was obtained in the same manner as in Example 1 except that polyurethane resin as flexible spherical particles of Example 1 was changed to hard aluminum particles treated by a follow method.

Compressive strength of the intermediate transfer belt N was 76.0 MPa. Restoring ratio of the intermediate transfer belt N was 2.2%.

—Treatment of Aluminum Particle—

1 parts by mass of silane coupling agent (sulfide series "KBE-846" manufactured by Shin-Etsu Chemical Co., Ltd.) were charged in 500 parts of ethanol and the resultant was stirred with a vaned agitator at 300 rpm for 30 min. The obtained 501 parts of solution were added 100 parts of aluminum particles ("A32" average particle diameter; 1 μm manufactured by NIPPON LIGHT METAL COMPANY, Ltd.) and the resultant was stirred with a vaned agitator at 300 rpm for 30 min. While the obtained 601 parts of dispersion liquid were stirred at 100 rpm, organic solvent (ethanol) were removed at 40° C. under reduced pressure, cooled, and separated solid-liquid with nutsche type filtration. And the resultant was dried for 2 hours at 80° C. and the surface-treated aluminum particles were obtained.

Comparative Example 4

An intermediate transfer belt O of Comparative Example 4 was obtained in the same manner as in Example 1 except that polyurethane resin as flexible spherical particles of Example 1 was changed to melamine resin hard particles ("EPOSTAR S21" average particle diameter; 1.2 μm manufactured by NIPPON SHOKUBAI CO., LTD.).

Compressive strength of the intermediate transfer belt O was 53.9 MPa. Restoring ratio of the intermediate transfer belt O was 6.1%.

The intermediate transfer belt A to O were evaluated as below method. The result were shown in Table 1 to Table 5.

<Evaluation of Transferability at Low-Temperature and Low-Humidity>

Intermediate Transfer Belts A to O of Examples and Comparative Examples above were each mounted in an image forming apparatus (MP C6502 manufactured by RICOH Co., Ltd.) of FIG. 8. 10,000 of black halftone images were produced with coated thick paper (POD GLOSSCOAT PAPER, 128 μm of average thickness manufactured by Oji Holdings Corporation) for A4 vertical printing at 10° C. and 15% RH.

Next 10 of black halftone image were produced with A3 POD GLOSSCOAT paper and then 10 of black halftone image were observed if there were vertical streaks to evaluate.

[Ranking for Judgment]

A: No vertical streaks in all 10 images. (Extremely good transferability)

B: 1 or 2 images have wispy vertical streaks. (Good transferability)

C: 3 to 5 images have wispy vertical streaks.

D: 6 or more images have vertical streaks clearly and are non-usable.

<Observation on the Surface of Intermediate Transfer Belt>

Parts of the intermediate transfer belt in contact with edge of A4 paper were observed with LEXTOLS4100 and confirmed if there were detachment of particles.

<Observation Irregular Surface on the Elastic Layer>

The surface of the elastic layer were observed with LEXTOLS4100 and confirmed if there were irregular surface.

<Micro Rubber Hardness of the Elastic Layer>

Micro rubber hardness of the elastic layer was measured with "Micro Durometer MD-1" manufactured by KOBUNSHIKEIKI CO., LTD.

<Embedding Rate of Spherical Particles>

Average of 10 embedding rates in the elastic layer in the depth direction was calculated by observing with a scanning electron microscope (SEM "VE-7800" manufactured by KEYENCE CORPORATION) by 5,000 times.

<The Rate of the Spherical Particles Occupying the Exposed Surface of the Elastic Layer>

The rate of the spherical particles occupying the exposed surface of the elastic layer was calculated with LEXTOLS4100.

TABLE 2-continued

| | Intermediate Transfer Belt | Spherical Particles on Elastic Layer Hard Particles | | | | |
|---|---|---|---|---|---|---|
| | | Resin | Shape | Average Particle Diameter (μm) | Compressive Strength (MPa) | Restoring Ratio (%) |
| EX7 | G | Silicone | Spherical | 6 | 42.1 | 4.5 |
| EX8 | H | Silicone | Spherical | 11 | 43.5 | 3.9 |
| EX9 | I | Melamine | Spherical | 1.2 | 53.9 | 6.1 |
| EX10 | J | Melamine | Spherical | 1.2 | 53.9 | 6.1 |
| EX11 | K | Melamine | Spherical | 1.2 | 53.9 | 6.1 |
| COM1 | L | Silicone | Spherical | 6 | 42.1 | 4.5 |
| COM2 | M | Melamine | Spherical | 6.5 | 58.2 | 7.7 |
| COM3 | N | Aluminum + Silane Coupling Agent | Spherical | 1 | 76.0 | 2.2 |
| COM4 | O | Melamine | Spherical | 1.2 | 53.9 | 6.1 |

TABLE 1

| | Intermediate Transfer Belt | Spherical Particles on Elastic Layer Flexible Particles | | | | |
|---|---|---|---|---|---|---|
| | | Resin | Shape | Average Particle Diameter (μm) | Compressive Strength (MPa) | Restoring Ratio (%) |
| EX1 | A | Polyurethane | Spherical | 7 | 3.6 | 42.5 |
| EX2 | B | Crosslinked Polybutyl Methacrylate | Spherical | 5 | 18.9 | 19.7 |
| EX3 | C | Crosslinked Polyacrylic Ester | Spherical | 8 | 11.5 | 24.6 |
| EX4 | D | Low Density Polyethylene | Spherical | 6 | 25.6 | 17.5 |
| EX5 | E | ethylene-methyl methacrylate copolymer (EMMA) | Spherical | 10 | 28.3 | 15.5 |
| EX6 | F | Polyurethane | Spherical | 7 | 3.6 | 42.5 |
| EX7 | G | Polyurethane | Spherical | 7 | 3.6 | 42.5 |
| EX8 | H | Polyurethane | Spherical | 7 | 3.6 | 42.5 |
| EX9 | I | ethylene-methyl methacrylate copolymer (EMMA) | Spherical | 10 | 28.3 | 15.5 |
| EX10 | J | Polyurethane | Spherical | 7 | 3.6 | 42.5 |
| EX11 | K | Polyurethane | Spherical | 7 | 3.6 | 42.5 |
| COM1 | L | — | — | — | — | — |
| COM2 | M | — | — | — | — | — |
| COM3 | N | — | — | — | — | — |
| COM4 | O | — | — | — | — | — |

TABLE 2

| | Intermediate Transfer Belt | Spherical Particles on Elastic Layer Hard Particles | | | | |
|---|---|---|---|---|---|---|
| | | Resin | Shape | Average Particle Diameter (μm) | Compressive Strength (MPa) | Restoring Ratio (%) |
| EX1 | A | — | — | — | — | — |
| EX2 | B | — | — | — | — | — |
| EX3 | C | — | — | — | — | — |
| EX4 | D | — | — | — | — | — |
| EX5 | E | — | — | — | — | — |
| EX6 | F | Melamine | Spherical | 1.2 | 53.9 | 6.1 |

TABLE 3

| | Ratio of Number of particles (A1:B1) | Ratio of Average Particle Diameter (A2/B2) |
|---|---|---|
| EX1 | 10:0 | — |
| EX2 | 10:0 | — |
| EX3 | 10:0 | — |
| EX4 | 10:0 | — |
| EX5 | 10:0 | — |
| EX6 | 5:5 | 5.8 |
| EX7 | 5:5 | 1.2 |
| EX8 | 5:5 | 0.6 |
| EX9 | 5:5 | 8.3 |
| EX10 | 9:1 | 5.8 |

TABLE 3-continued

| | Ratio of Number of particles (A1:B1) | Ratio of Average Particle Diameter (A2/B2) |
|---|---|---|
| EX11 | 1:9 | 5.8 |
| COM1 | 0:10 | — |
| COM2 | 0:10 | — |
| COM3 | 0:10 | — |
| COM4 | 0:10 | — |

TABLE 4

| | Evaluation | |
|---|---|---|
| | Transferability at low-temperature and low-humidity | Detachment of Particles at parts of the intermediate transfer belt in contact with edge of A4 paper |
| EX1 | A | No |
| EX2 | A | No |
| EX3 | A | No |
| EX4 | B | a small percentage of particles detached |
| EX5 | C | more detachments of particles than EX4 |
| EX6 | A | No |
| EX7 | A | No |
| EX8 | B | a small percentage of particles detached |
| EX9 | B | a small percentage of particles detached |
| EX10 | C | more detachments of particles than EX5 |
| EX11 | B | a small percentage of particles detached |
| COM1 | D | particles totally detached |
| COM2 | D | particles totally detached |
| COM3 | D | particles totally detached |
| COM4 | D | particles totally detached |

TABLE 5

| | Irregular Surface on the Elastic Layer | Micro Rubber Hardness of the elastic layer | Embedding Rate of spherical particles (%) | The rate of the spherical particles occupying the exposed surface of the elastic layer (%) |
|---|---|---|---|---|
| EX1 | exist | 37 | 60 | 70 |
| EX2 | exist | 37 | 65 | 75 |
| EX3 | exist | 37 | 57 | 66 |
| EX4 | exist | 37 | 63 | 72 |
| EX5 | exist | 37 | 54 | 63 |
| COM1 | exist | 37 | 63 | 73 |
| COM2 | exist | 37 | 62 | 68 |
| COM3 | exist | 37 | 75 | 90 |

As shown in Table 1 to Table 5, since Intermediate transfer Belt of Example 1 to 11 were used flexible particles having low compressive strength and high restoring ratio, it was difficult to detach particles and for vertical streams to occur.

However, Intermediate transfer Belt of Comparative Example 1 to 4 using only hard particles having high compressive strength and low restoring ratio detachment of spherical particles at low-temperature and low-humidity occurred and vertical streams occurred.

The present application can provide an intermediate transfer belt and an image forming apparatus (Especially full-color image apparatus) capable of high transferability, inhibiting detachment of particles at low-temperature and low-humidity and high durability.

Moreover, Intermediate transfer Belt of Example 6 to 11 were evaluated for transferability at high-temperature and high-humidity to test an effect of using 2 kinds of spherical particles. The results were shown in Table 6.

<Evaluation of Transferability at High-Temperature and High-Humidity>

Intermediate Transfer Belts F to K of Examples 6 to 11 were each mounted in an image forming apparatus (MP C6502 manufactured by RICOH Co., Ltd.) of FIG. 8. 10,000 of blue solid image by cyan and magenta were produced with coated thick paper (POD GLOSSCOAT PAPER, 128 μm of average thickness manufactured by Oji Holdings Corporation) for A4 vertical printing at 23° C. and 50% RH (at mid-temperature and mid-humidity) and at 30° C. and 85% RH (at high-temperature and high-humidity).

Next 10 of blue solid image were produced with A3 POD GLOSSCOAT paper at each conditions and then 10 of blue solid image were observed image density visually.

[Ranking for Judgment]

A: No decrease of image density at high-temperature and high-humidity as compared to at mid-temperature and mid-humidity B: A little decrease of image density at high-temperature and high-humidity as compared to at mid-temperature and mid-humidity C: A little more decrease of image density at high-temperature and high-humidity as compared to B (But image can be used)

D: Decrease of image density at high-temperature and high-humidity as compared to at mid-temperature and mid-humidity (image can't be used)

TABLE 6

| | Evalution Transferability at high-temperature and high-humidity |
|---|---|
| EX6 | A |
| EX7 | B |
| EX8 | C |
| EX9 | B |
| EX10 | B |
| EX11 | C |

As shown in Table 6, the good effect to transferability at high-temperature and high-humidity was attained by using flexible particles and hard particles. Moreover, there is no description in this specification, but an intermediate transfer belt having only flexible particles can't attain the effect to transferability at high-temperature and high-humidity.

Embodiments of the present application are, for example, as follows.

<1> An intermediate transfer belt, configured to receive a toner image formed by developing a latent image formed on an image bearing member with a toner, comprising a base layer and an elastic layer wherein the elastic layer on the base layer has irregular surface formed with spherical particles, wherein the spherical particles include flexible particles having 0.1 MPa to 30 MPa of compressive strength and 15% to 50% of restoring ratio at the time of 10% deformation.

<2> The intermediate transfer belt according to <1>, wherein the spherical particles are true spheres.

<3> The intermediate transfer belt according to <1>, wherein the flexible particles are polyurethane resin.

<4> The intermediate transfer belt according to <1>, wherein flexible particles are acrylate resin.

<5> The intermediate transfer belt according to <1>, wherein the spherical particles include hard particles having beyond 30 MPa of compressive strength and less than 15% of restoring ratio at the time of 10% deformation.

<6> The intermediate transfer belt according to <5>, wherein the hard particles are melamine resin.

<7> The intermediate transfer belt according to <5>, wherein a ratio of number of the flexible particles (A1) to number of the hard particles (B1) is 4/1 to 1/4.

<8> The intermediate transfer belt according to <5>, wherein a ratio of an average particle diameter of the flexible particles (A2) to an average particle diameter of the hard particles (B2) is 0.8 to 10.

<9> The intermediate transfer belt according to <1>, wherein the elastic layer includes acrylic rubber.

<10> The intermediate transfer belt according to <1>, wherein the intermediate transfer belt is a seamless belt.

<11> An image forming apparatus comprising an image bearing member configured to form a latent image thereon and to bear a toner image a developing unit configured to develop the latent image formed on the image bearing member with a toner an intermediate transfer belt to which the toner image developed by the developing unit is primary transferred; and a transfer unit configured to secondary transfer the toner image born on the intermediate transfer belt to a recording medium, wherein the intermediate transfer belt is the belt for an image forming apparatus, as defined in <1>.

<12> The image forming apparatus according to <11>, wherein the image forming apparatus is a full-color image forming apparatus containing a plurality of the image bearing members provided tandemly, each of which has the developing unit for a corresponding color to constitute a full-color.

<13> An image forming method comprising a developing step to develop the latent image formed on an image bearing member with a toner a primary transferring step to transfer a toner image on an intermediate transfer belt and a secondary transferring step to transfer the toner image to a recording medium wherein the intermediate transfer belt is the intermediate transfer belt according to <1>.

Preferred embodiments herein include the following:

1. An intermediate transfer belt comprising:

a base layer; and an elastic layer;

wherein the elastic layer is located over the base layer and has an irregular surface comprising partially embedded spherical particles on a side opposite the base layer, wherein the spherical particles comprise flexible particles having 0.1 MPa to 30 MPa of compressive strength and 15% to 50% of restoring ratio at the time of 10% deformation, and wherein the intermediate transfer belt is configured to receive a toner image formed by developing a latent image formed on an image bearing member with a toner on said irregular surface.

2. The intermediate transfer belt according to embodiment 1, wherein the spherical particles are true spheres.

3. The intermediate transfer belt according to embodiment 1, wherein the flexible particles are polyurethane resin flexible particles.

4. The intermediate transfer belt according to embodiment 1, wherein flexible particles are acrylate resin flexible particles.

5. The intermediate transfer belt according to embodiment 1, wherein the spherical particles further comprise hard particles having a compressive strength greater than 30 MPa and less than 15% of restoring ratio at the time of 10% deformation.

6. The intermediate transfer belt according to embodiment 5, wherein the hard particles are melamine resin hard particles.

7. The intermediate transfer belt according to embodiment 5, wherein a ratio of the number of flexible particles (A1) to the number of the hard particles (B1) is 4/1 to 1/4.

8. The intermediate transfer belt according to embodiment 5, wherein a ratio of an average particle diameter of the flexible particles (A2) to an average particle diameter of the hard particles (B2) is 0.8 to 10.

9. The intermediate transfer belt according to embodiment 1, wherein the elastic layer further comprises acrylic rubber.

10. The intermediate transfer belt according to embodiment 1, wherein the intermediate transfer belt is a seamless belt.

11. The intermediate transfer belt according to embodiment 1, wherein the elastic layer is in contact with the base layer.

12. An image forming apparatus comprising:

an image bearing member configured to form a latent image thereon and to bear a toner image;

a developing unit configured to develop the latent image formed on the image bearing member with a toner;

an intermediate transfer belt to which the toner image developed by the developing unit is primary transferred; and a transfer unit configured to secondary transfer the toner image born on the intermediate transfer belt to a recording medium, wherein the intermediate transfer belt is the intermediate transfer belt of embodiment 1.

13. The image forming apparatus according to embodiment 12, wherein the image forming apparatus is a full-color image forming apparatus containing a plurality of the image bearing members provided tandemly, each of which has the developing unit for a corresponding color to constitute a full-color.

14. An image forming method comprising:

a developing step to develop the latent image formed on an image bearing member with a toner;

a primary transferring step to transfer a toner image on an intermediate transfer belt and, a secondary transferring step to transfer the toner image to a recording medium, wherein the intermediate transfer belt is the intermediate transfer belt of embodiment 1.

As used herein the terms composed of, contains, containing, and terms similar thereto, when referring to the ingredients, parts, reactants, etc., of a composition, component, etc., to method steps, etc., mean, in their broadest sense, "includes at least" (i.e., comprises) but also include within their definition all those gradually restricted meanings until and including the point where only the enumerated materials or steps are included (e.g., consisting essentially of and consisting of).

The above written description of the invention provides a manner and process of making and using it such that any person skilled in this art is enabled to make and use the same, this enablement being provided in particular for the subject matter of the enumerated embodiments and appended claims, which make up a part of the original description. As used herein, the phrases "selected from the group consisting of," "chosen from," and the like include mixtures of the specified materials. The term "mentioned" notes exemplary embodiments, and is not limiting to certain species. As used herein the words "a" and "an" and the like carry the meaning of "one or more." When a polymer is referred to in shorthand notation as comprising a monomer (or like phrases), the monomer is present in the polymer in polymerized form.

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use what is described herein, and is provided in the context of a particular application and its requirements. Various modifications to the preferred embodiments will be readily apparent to those skilled in the art, and the generic principles defined herein may be applied to other embodiments and applications without departing from its spirit and scope. Thus, this application is not intended to be limited to the embodiments shown, but is to be accorded the widest scope consistent with the principles and features disclosed herein. In this regard, certain embodiments described may not show every benefit mentioned, considered broadly.

What is claimed is:

1. An intermediate transfer belt comprising:

a base layer; and an elastic layer;

wherein the elastic layer is located over the base layer and has an irregular surface comprising partially embedded spherical particles on a side opposite the base layer, wherein the spherical particles comprise flexible particles having 0.1 MPa to 30 MPa of compressive strength and 15% to 50% of restoring ratio at the time of 10% deformation, wherein the intermediate transfer belt is configured to receive a toner image formed by developing a latent image formed on an image bearing member with a toner on said irregular surface, and wherein the spherical particles further comprise hard particles having a compressive strength greater than 30 MPa and less than 15% of restoring ratio at the time of 10% deformation.

2. The intermediate transfer belt according to claim 1, wherein the spherical particles are true spheres.

3. The intermediate transfer belt according to claim 1, wherein the flexible particles are polyurethane resin flexible particles.

4. The intermediate transfer belt according to claim 1, wherein flexible particles are acrylate resin flexible particles.

5. The intermediate transfer belt according to claim 1, wherein the hard particles have a compressive strength of greater than 30 to 90 MPa and less than 1500 to 0% of restoring ratio at the time of 10% deformation.

6. The intermediate transfer belt according to claim 1, wherein the hard particles are melamine resin hard particles.

7. The intermediate transfer belt according to claim 1, wherein a ratio of the number of flexible particles (A1) to the number of the hard particles (B1) is 4/1 to 1/4.

8. The intermediate transfer belt according to claim 1, wherein a ratio of an average particle diameter of the flexible particles (A2) to an average particle diameter of the hard particles (B2) is 0.8 to 10.

9. The intermediate transfer belt according to claim 1, wherein the elastic layer further comprises acrylic rubber.

10. The intermediate transfer belt according to claim 1, wherein the intermediate transfer belt is a seamless belt.

11. The intermediate transfer belt according to claim 1, wherein the elastic layer is in contact with the base layer.

12. An image forming apparatus comprising:

an image bearing member configured to form a latent image thereon and to bear a toner image, a developing unit configured to develop the latent image formed on the image bearing member with a toner, an intermediate transfer belt to which the toner image developed by the developing unit is primary transferred; and a transfer unit configured to secondary transfer the toner image born on the intermediate transfer belt to a recording medium, wherein the intermediate transfer belt is the intermediate transfer belt of claim 1.

13. The image forming apparatus according to claim 12, wherein the image forming apparatus is a full-color image forming apparatus containing a plurality of the image bearing members provided tandemly, each of which has the developing unit for a corresponding color to constitute a full-color.

14. An image forming method comprising:

a developing step to develop the latent image formed on an image bearing member with a toner;

a primary transferring step to transfer a toner image on an intermediate transfer belt and, a secondary transferring step to transfer the toner image to a recording medium, wherein the intermediate transfer belt is the intermediate transfer belt of claim 1.

15. The intermediate transfer belt according to claim 5, wherein the hard particles are melamine resin hard particles.

16. The intermediate transfer belt according to claim 5, wherein a ratio of the number of flexible particles (A1) to the number of the hard particles (B1) is 4/1 to 1/4.

17. The intermediate transfer belt according to claim 5, wherein a ratio of an average particle diameter of the flexible particles (A2) to an average particle diameter of the hard particles (B2) is 0.8 to 10.

18. The intermediate transfer belt according to claim 3, wherein the hard particles are melamine resin hard particles.

19. The intermediate transfer belt according to claim 15, wherein the flexible particles are polyurethane resin flexible particles.

* * * * *